US008157885B2

(12) United States Patent
Blumbergs

(10) Patent No.: US 8,157,885 B2
(45) Date of Patent: Apr. 17, 2012

(54) CONTINUOUS PRODUCTION OF METALLIC TITANIUM AND TITANIUM-BASED ALLOYS

(75) Inventor: Ervins Blumbergs, Jurmala (LV)

(73) Assignee: Baltic Titan Limited, London (GB)

( * ) Notice: Subject to any disclaimer, the term of this patent is extended or adjusted under 35 U.S.C. 154(b) by 77 days.

(21) Appl. No.: 12/806,134

(22) Filed: Aug. 6, 2010

(65) Prior Publication Data

US 2010/0319488 A1 Dec. 23, 2010

Related U.S. Application Data

(63) Continuation of application No. 12/381,720, filed on Mar. 16, 2009, now Pat. No. 7,776,128, which is a continuation of application No. PCT/LV2007/000002, filed on May 22, 2007.

(30) Foreign Application Priority Data

Sep. 25, 2006 (LV) ..... P-06-111

(51) Int. Cl.
*C22B 4/00* (2006.01)
*C22B 4/04* (2006.01)
*C22B 34/10* (2006.01)

(52) U.S. Cl. ..... 75/10.62; 266/186

(58) Field of Classification Search ..... 75/10.62; 266/186

See application file for complete search history.

(56) References Cited

U.S. PATENT DOCUMENTS 2,205,854 A 6/1940 Kroll
3,825,415 A 7/1974 Johnston et al. ..... 85/84.5
3,847,596 A 11/1974 Holland et al. ..... 75/84.4
4,877,445 A 10/1989 Okudaira et al. ..... 75/366
5,679,983 A 10/1997 Ishigami et al. ..... 257/765
6,136,060 A 10/2000 Joseph ..... 75/10.19

(Continued)

FOREIGN PATENT DOCUMENTS

EP 0299791 7/1987

(Continued)

OTHER PUBLICATIONS

Sibum et al. "Titanium, Titanium Alloys, and Titanium Compounds." Ullman's Encyclopedia of Industrial Chemistry. Jun. 15, 2000.*

(Continued)

*Primary Examiner* — Jessica L Ward
*Assistant Examiner* — Alexander Polyansky
(74) *Attorney, Agent, or Firm* — Imperium Patent Works; Darien K. Wallace

(57) ABSTRACT

Metallic titanium is continuously produced in an electric-arc furnace under a vacuum by the metallothermic reduction of titanium tetrachloride by a reducing agent such as magnesium. The nanoparticles of titanium obtained from the reduction are simultaneously melted in a bath of molten titanium formed by the heat of an electric arc between a consumable titanium electrode and the molten titanium. A voltage applied across the electrode and the molten titanium is adjusted so that molten titanium is maintained in a cooled crystallizer during the entire process. The molten titanium solidifies on the top of a dummy bar that is drawn down as additional titanium is produced. Upon completion of each iterative reduction reaction, the vaporized reducing agent chloride is pumped out of the electric-arc furnace into a condenser using a vacuum pump. Then, additional reducing agent and titanium tetrachloride are added into the furnace, and the process is repeated.

20 Claims, 2 Drawing Sheets

U.S. PATENT DOCUMENTS

| | | | | |
|---|---|---|---|---|
| 2002/0005090 | A1 | 1/2002 | Armstrong et al. | 75/617 |
| 2004/0161379 | A1* | 8/2004 | Kim et al. | 423/440 |
| 2004/0237711 | A1 | 12/2004 | Ono et al. | 75/10.58 |
| 2006/0107788 | A1 | 5/2006 | Okabe et al. | 75/245 |

FOREIGN PATENT DOCUMENTS

| | | |
|---|---|---|
| GB | 1355433 | 7/1971 |

OTHER PUBLICATIONS

Written Opinion of the Int'l Searching Authority (European Patent Office) in the PCT application PCT/LV07/000002 filed on May 22, 2007 (8 pages).

Polmear: "Light Alloys" 1989, Edward Arnold, UK, XP002446584; pp. 14-17.

* cited by examiner

CONTINUOUS PRODUCTION OF METALLIC TITANIUM AND TITANIUM-BASED ALLOYS

CROSS REFERENCE TO RELATED APPLICATION

This application is a continuation of, and claims priority under 35 U.S.C. §120 from, nonprovisional U.S. patent application Ser. No. 12/381,720 entitled "Continuous Production of Metallic Titanium and Titanium Based Alloys," filed on Mar. 16, 2009, now U.S. Pat. No. 7,776,128. Application Ser. No. 12/381,720 in turn is a continuation of, and claims priority under 35 U.S.C. §120 and §365(c) from International Application No. PCT/LV2007/000002, filed on May 22, 2007, and published as WO 2008/039047 A1 on Apr. 3, 2008, which in turn claims priority from Latvian Application No. P-06-111, filed on Sep. 25, 2006. Application Ser. No. 12/381,720 claims the benefit under 35 U.S.C. §119 from Latvian Application No. P-06-111. The disclosure of each of the foregoing documents is incorporated herein by reference.

TECHNICAL FIELD

The present invention relates to nonferrous metallurgy, and more particularly, to a method of continuously producing metallic titanium and metallic titanium alloys by the metallothermic reduction of titanium tetrachloride, and also to the devices for producing metallic titanium or its alloys.

BACKGROUND

There are known methods of producing metallic titanium by the reduction of titanium tetrachloride using magnesium or sodium with the subsequent crushing and melting of spongy titanium in a vacuum-arc furnace to obtain ingots. These are variations of Kroll's method. With any version of the technological process of metallothermic reduction using Kroll's method, a purified titanium tetrachloride is fed into a sealed reactor that is filled with argon. A reducing agent is already present in the reactor or is fed into the reactor simultaneously with the titanium tetrachloride. The upper limit of the temperature of the process is limited by the durability of the steel equipment used, and the lower limit is determined by the melting point of the chlorides obtained as a result of reduction. After the completion of the titanium tetrachloride reduction by the reducing agent and the vacuum separation of the products of the reaction (usually in a magnesium-thermic process), a titanium sponge is extracted from the reactor by drilling or by pressing out. Then the titanium sponge is crushed. Then the crushed titanium sponge is melted down to ingots. This method is described in "Titanium. Properties, Source Of Raw Materials, Physicochemical Fundamentals And Method Of Obtaining Thereof," (Moscow) Metallurgy, 1983, p. 339-342 (Титан, Свойства, сырьевая база, физико-химические основы и способы получения. М.: Металлургия, 1983. С. 339-342)

Traditionally, the melting of titanium sponge has been conducted either in a vacuum-arc furnace or in an atmosphere of inert gas. However, melting in a vacuum has the advantage that during the melting the bath of metal boils. The removal of volatile impurities, such as hydrogen, moisture, reducing agent and reducing agent chloride) from metallic titanium is conducted considerably faster than during the melting under the pressure of an inert gas. Melting in a vacuum produces a better quality metal. One known technological scheme for producing metallic ingots of titanium by melting in a vacuum-arc furnace involves a primary melting of a consumable electrode that is made of the pressed titanium sponge. An electric arc burns between a bath of liquid metal and the consumable electrode, and the melting metal flows down to the bath. A secondary melting is conducted in a casting mold of larger diameter than that used in the primary melting. The consumable electrodes for the secondary melting are produced by welding together several electrodes obtained from the primary melting. This method is described in "Titanium Metallurgy," (Moscow) Metallurgy, 1964, p. 182-184 (Металлургия титана. М.: Металлургия, 1964. С. 182-184).

The main disadvantage of these methods is that the process of producing metallic titanium is divided into several stages. This leads to a long duration of the process of producing metallic titanium and to low productivity of the devices that implement these methods.

Another method of producing metallic titanium involves reducing titanium from its chloride using a reducing metal and a reducing agent. U.S. Pat. No. 3,847,596, entitled "Process of obtaining metals from metal halides", describes feeding a titanium chloride (such as titanium tetrachloride in a gaseous form) and a reducing agent (such as liquid magnesium) into an evacuated and pre-heated reactor in which an exothermic reaction occurs. The reduction reaction is achieved at a temperature higher than the melting point of the metal to be produced and at a pressure not lower than the pressure of evaporating gases of the reducing agent chloride. First, titanium is formed in a solid form. As a result of the reduction reaction, the reducing agent chloride is heated under atmospheric pressure to a vaporization temperature and changes to a gaseous state until the pressure of the gases (pressure of molten reducing agent chloride, pressure of molten titanium and pressure of inert gas introduced into the reactor) reaches the pressure that corresponds to the temperature of substitution in the reaction. From this point on, the reducing agent chloride appears only in a liquid state. The subsequent substitution occurs at the pressure of the obtained flux and at a temperature higher than the melting point of titanium. The result of the process is melted titanium. Thus liquid titanium is produced in the reactor. The chloride of the liquid reducing agent forms a layer and floats on the surface of the liquid titanium. The liquid titanium is continuously removed from the reactor through a cooled copper ingot mold under an argon atmosphere or in a vacuum.

A disadvantage of this method is that the metallic titanium obtained is heavily saturated with residual chlorine, metallic magnesium and magnesium chloride, as well as with hydrogen and other gases that are generated from the admixtures of titanium tetrachloride and reducing agent. Furthermore, the industrial application of this method is complicated by the problem of obtaining a material for the reactor that can withstand temperatures higher than the melting point of titanium.

Yet another known method of producing metallic titanium enables the continuous production of metallic titanium through the reduction of titanium tetrachloride by a reducing agent. This method is described in European Patent No. EP 0 299 791, entitled "Method for producing metallic titanium and apparatus therefor." The method requires the temperature in a reaction zone of a reactor to exceed the melting point of titanium. The pressure in the reaction zone must exceed the pressure of a gaseous reducing agent. The method involves supplying titanium tetrachloride and the reducing agent (e.g., magnesium) into the reactor such that metallic titanium and by-product (the chloride of the reducing agent) are produced while the metallic titanium and by-product are maintained in a molten form. The metallic titanium and the by-product are separated by using the difference in their densities. Metallic titanium is collected at and continuously extracted from the bottom of the reactor.

The device used for this method includes the reactor, pipes for supplying titanium tetrachloride and the reducing agent, heating elements and means for extracting the metallic titanium. The reactor has a reaction zone for maintaining a temperature higher than the melting point of titanium and for maintaining a pressure sufficient to prevent the boiling of the reducing agent (e.g., magnesium) and its chloride. There is one pipe for supplying the reducing agent in a liquid state into the reaction zone through the reactor's lateral side or upper part. There is another pipe for supplying titanium tetrachloride into the reaction zone through the reactor's upper part. The by-product (the chloride of the reducing agent) is discharged through a discharge pipe from the reactor's lateral side. Heating elements are mounted on the reactor's outer side at the level of the reaction zone. The device has a means for continuously extracting metallic titanium from the bottom of the reactor.

A disadvantage of this method is the need to maintain a high pressure (about 50 atmospheres) in the reaction zone in order to prevent the reducing agent and its chloride from boiling. In addition, a temperature must be maintained in the reaction zone that exceeds the melting point of titanium. The high temperature and pressure requirements of this method create problems from escaping gas and even bursting reactors. Thus, this method provides an insufficient level of safety for producing metallic titanium. Furthermore, producing metallic titanium at high pressure in the rector leads to a heavy saturation of the metallic titanium by chlorine residue, metallic magnesium, magnesium chloride, hydrogen and other gases generated from titanium tetrachloride admixtures and the reducing agent. The heavy saturation with impurities leads to producing metallic titanium of insufficient quality.

SUMMARY

A method is disclosed for continuously producing metallic titanium and metallic titanium alloys through a metallothermic reduction of titanium tetrachloride. The method includes: maintaining the temperature in a reaction zone in a reactor that exceeds the boiling point of a titanium reducing agent; supplying titanium tetrachloride and the reducing agent to the reactor to produce a metallic titanium or its metallic alloy and a by-product while maintaining the metallic titanium or its metallic alloy and the by-product in the molten and vaporized form; separating the metallic titanium or its metallic alloy and the reducing agent chloride; collecting the metallic titanium or its metallic alloy at the bottom of the reactor; and continuously extracting the metallic titanium or its metallic alloy from the bottom of the reactor, wherein the reduction of titanium tetrachloride by the reducing agent and the melting of spongy titanium produced are conducted simultaneously in a vacuum in an electric-arc furnace.

In one embodiment, the by-product of the reaction of titanium tetrachloride and the reducing agent is a chloride of the reducing agent. The separation of the produced metallic titanium or its metallic alloy and the reducing agent chloride is performed by pumping out the reducing agent chloride from the reaction zone of the electric-arc furnace to the condenser. The reduction of titanium tetrachloride is conducted at a temperature that is higher than the boiling point of the metallic titanium reducing agent, but lower than the melting point of metallic titanium.

A device is disclosed for continuously producing metallic titanium or metallic titanium alloy. The device includes an electric-arc furnace, a crystallizer, a cooling system for the crystallizer and a vacuum pump. The electric-arc furnace has a reaction zone, various apertures and heating elements. The reaction zone maintains a temperature that exceeds the boiling point of a metallic titanium reducing agent. A first aperture in the wall of the electric-arc furnace supplies a liquid reducing agent to the reaction zone. A second aperture in the wall of the electric-arc furnace supplies titanium tetrachloride to the reaction zone. A third aperture in the wall of the electric-arc furnace is for removal of a reducing agent chloride from the reaction zone. The heating elements are mounted at the level of the reaction zone. The crystallizer of the device is for installing a dummy bar and for forming metallic titanium.

The device carries out the reduction of titanium tetrachloride through the reducing metal agent in a vacuum by simultaneously melting spongy titanium and producing metallic titanium or its alloy. The electric-arc furnace is connected to the vacuum pump and includes a consumable electrode that functions as a cathode. A voltage is supplied to an anode that serves a liquid bath of titanium or titanium alloy located in the cooled crystallizer at the upper part of the dummy bar.

In one embodiment, the walls of the electric-arc furnace are made of niobium or tantalum. The walls of the electric-arc furnace are covered by a casing that prevents the absorption of oxygen and other gases. The consumable electrode is made of titanium, a titanium alloy, from another metal or a compound of other metals. The consumable electrode is filled with one or more of the following additional chemical elements: aluminum, silicon, vanadium, chromium, manganese, iron, cobalt, nickel, copper, zirconium, niobium, molybdenum, ruthenium, palladium, silver, hafnium, tantalum, tungsten, lead, bismuth or polonium.

The cooling system for the crystallizer includes a condenser. A pipe that discharges cooled reducing agent chloride is connected to the electric-arc furnace at the third aperture. The pipe is used to collect reducing agent chloride from the electric-arc furnace.

Other embodiments and advantages are described in the detailed description below. This summary does not purport to define the invention. The invention is defined by the claims.

BRIEF DESCRIPTION OF THE DRAWINGS

The accompanying drawing illustrates embodiments of the invention.

DETAILED DESCRIPTION

Figure 1:
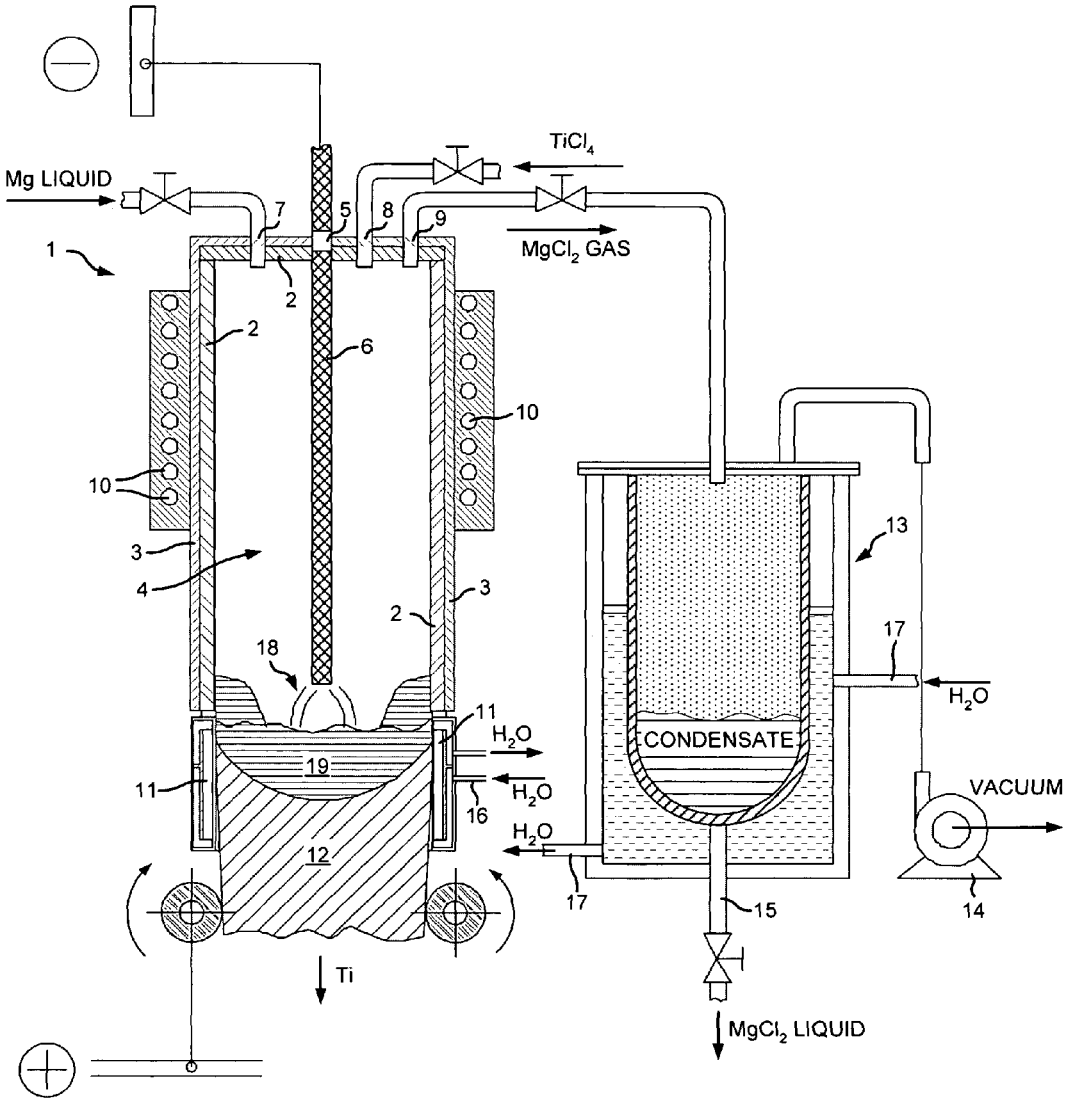
FIG. 1 is a schematic diagram of a device for producing metallic titanium with an improved quality and with an increased efficiency and safety level.

Reference will now be made in detail to some embodiments of the invention, examples of which are illustrated in the accompanying drawing.

A method is disclosed for continuously producing metallic titanium and metallic titanium alloys by the metallothermic reduction of titanium tetrachloride. The titanium tetrachloride is reduced by a reducing agent in a vacuum and the resulting nanoparticles of titanium settle to the bottom of, and are simultaneously melted in, an electric-arc furnace of a direct-current reactor. As used herein, the term vacuum does not denote a space totally devoid of matter. The method for continuously producing metallic titanium yields the best quality and efficiency when certain steps of the method achieve a vacuum in the reaction zone corresponding to a pressure of about $1\times10^{-2}$ mm of mercury. The pressure at other steps of the reaction goes as low as $1\times10^{-3}$ mm of mercury and as high as 760 mm of mercury when the reducing agent is added and vaporizes.

A means of producing metallic titanium is disclosed that eliminates the deficiencies of prototype reactors that use carrier gases and reaction temperatures above the melting point of titanium. The disclosed means raises the safety level of a process for producing metallic titanium, improves the quality of the metallic titanium obtained and increases the productivity of the device for continuously producing metallic titanium and metallic titanium alloys.

A device for continuously producing metallic titanium or metallic titanium alloys allows the reduction of titanium tetrachloride by the reducing agent to be performed in a vacuum with the simultaneous melting of nanoparticles of titanium to produce metallic titanium or its alloys. The device includes a reactor in the form of an electric-arc furnace that is connected to a vacuum pump and is supplied with a consumable electrode. The electrode functions as a cathode to which a voltage is supplied. A liquid bath of molten titanium or titanium alloy serves as the anode and is located in a cooled crystallizer at the upper part of a dummy bar of titanium.

The electric-arc furnace is supplied with the consumable electrode of titanium or a titanium alloy metal and is filled with additional chemical elements for obtaining titanium alloys. In another embodiment, the consumable electrode contains another pure metal or an alloy of a plurality of other metals. The separation of metallic titanium and the chloride of the reducing agent occurs due to the difference in densities of metallic titanium or its alloy and the reducing agent chloride, and also due to the periodic removal of reducing agent chlorides to a condenser.

The safety level of the process of producing metallic titanium is increased by carrying out the reduction of titanium tetrachloride by the reducing agent in a vacuum. Moreover, the quality of the metallic titanium obtained and the efficiency of the device used for continuously producing metallic titanium are increased by combining the process of reducing titanium tetrachloride with a reducing agent and the process of melting spongy titanium produced in a vacuum-arc furnace. But instead of spongy titanium being produced in the disclosed method, nanoparticles of titanium are produced from gaseous raw materials and settle down to a bath of molten titanium, where the nanoparticles melt.

FIG. 1 shows a device for continuously producing metallic titanium or a metallic titanium alloy without the intermediate stage of producing titanium sponge. The device includes an electric-arc furnace 1, a condenser 13 and cooling systems 16-17. The electric-arc furnace 1 includes walls 2, a casing 3, a reaction zone 4, an electric holder 5 for installing a consumable electrode 6, apertures 7-9, heating elements 10, a crystallizer 11 and a dummy bar 12.

The electric-arc furnace 1 acts as a reactor. The walls 2 are made of a material that can withstand the high temperatures at which the reduction of titanium tetrachloride ($TiCl_4$) by gaseous magnesium takes place. Walls 2 made of niobium (Nb) or tantalum (Ta) can withstand temperatures above the boiling point of magnesium. At very high temperatures, however, niobium (Nb) and tantalum (Ta) are degraded by oxygen. Therefore, the walls 2 are protected by a casing 3 made of stainless steel that prevents the absorption of oxygen and other gases. In addition, all gases are evacuated from the reaction zone 4 down to a pressure of at least as low as $5\times10^{-3}$ mm of mercury in order to prevent the niobium or tantalum walls 2 from oxidizing when the electric-arc furnace 1 is preheated before the raw materials are added. A temperature is maintained in the reaction zone 4 that is higher than the boiling point of a reducing agent. In addition, after each iterative reduction reaction is complete, a vacuum is created in the reaction zone 4 that removes the reducing agent residue (e.g., magnesium) and the chloride of the reducing agent from the reaction zone 4. A liquid reducing agent, such as liquid magnesium (Mg), is supplied into the reaction zone 4 through an aperture 7 in the wall of the electric-arc furnace 1. In other embodiments, other alkali metals are used as the reducing agent, such as potassium (K), calcium (Ca), sodium (Na), lithium (Li) or rubidium (Rb). The reducing agent is heated until the reducing agent melts into liquid form.

As the melted reducing agent enters the lower-pressure reaction zone 4, the liquid reducing agent vaporizes. Before the titanium reducing agent is added, the pressure in the reaction zone 4 is maintained at a pressure that is sufficiently low to vaporize all of the titanium reducing agent at any given temperature in the reaction zone, which is regulated to fall within a range from the boiling point of the titanium reducing agent to the melting point of metallic titanium. For a temperature in the reaction zone that corresponds to a surface temperature on the bath of molten titanium of about 1900 degrees Celsius, the pressure at the beginning of the reduction reaction required to vaporize all of the titanium reducing agent is about $10^{-2}$ mm of mercury. The atmosphere in the reaction zone 4 becomes saturated with the reducing agent, as some reducing agent condenses and then re-vaporizes. Reducing agent also re-vaporizes as a result of its vapor pressure decreasing as it is consumed in the reduction reaction.

After the reducing agent is present in the reaction zone 4, titanium tetrachloride is supplied into the reaction zone 4 through an aperture 8 in the wall of the electric-arc furnace 1. In one embodiment, titanium tetrachloride is not added to the reaction zone until about two seconds after the liquid reducing agent is added in order to allow the reducing agent time to vaporize and the atmosphere of the reaction zone to become saturated with the gaseous reducing agent. The boiling and vaporized reducing agent chloride, such as the by-product magnesium chloride ($MgCl_2$), is removed from the reaction zone 4 through an aperture 9 in the wall of the electric-arc furnace 1. The heating elements 10 are mounted on the outer side of electric-arc furnace 1 at the level of the reaction zone 4. The heating elements 10 form an inductor or a resistance furnace. The crystallizer 11 is used for installing a dummy bar 12 and for the formation of metallic titanium or a metallic titanium alloy at the bottom of the electric-arc furnace 1.

The device for continuously producing titanium also includes a condenser 13 for collecting the vaporized reducing agent chloride from the electric-arc furnace 1. The condenser 13 is connected to a vacuum pump 14. The cooled reducing agent chloride is discharged from the condenser 13 through a tube 15. A cooling system 16 is installed in the crystallizer 11 of the electric-arc furnace 1. Another cooling system 17 is installed in the condenser 13.

The method of continuously producing metallic titanium or metallic titanium alloy includes the following steps. A dummy bar 12 of metallic titanium or a metallic titanium alloy is inserted into the cooled crystallizer 11 and sealed hermetically. Crystallizer 11 is a casting mold located at the bottom of the electric-arc furnace 1 (a reactor). A consumable electrode 6 is placed in the electric holder 5 located on the wall of the electric-arc furnace 1 and is hermetically sealed. The consumable electrode 6 is made of titanium or a titanium alloy that optionally includes additional chemical elements, such as aluminum, silicon, molybdenum, chromium, vanadium, manganese, iron, nickel, bismuth, silver, niobium, tantalum, polonium, tungsten, zirconium or cobalt. In another embodiment, the consumable electrode 6 is made entirely of one of the above-mentioned elements other than titanium or from a compound of one of these elements. In one implementation wherein an aluminum-titanium alloy is produced, for example, the consumable electrode 6 is made entirely of aluminum.

At the beginning of the reduction reaction, vacuum pump 14 sucks the gases out of condenser 13 and also out of the reaction zone 4 via the pipe connected to aperture 9. Thus, a vacuum with a pressure at least as low as $5\times10^{-3}$ mm of mercury is created in the electric-arc furnace 1. Evacuating the gases out of the reaction zone 4 removes nearly all elements and compounds other than titanium from the reaction zone. Nearly the only impurities that remain in the reaction zone 4 are some heavy metal impurities from the titanium tetrachloride, such as vanadium (V), because heavy metals boil and vaporize in the electric arc at a rate proportional to that of titanium. Thus, the percentage of heavy-metal impurities does not decrease by evacuating gases. At the temperature in the reaction zone 4 that is reached under the conditions of the titanium reduction reaction described herein, nearly all elements and compounds other than titanium in the reaction zone have vaporized and can be evacuated using vacuum pump 14. It is also important to evacuate from the reaction zone into the condenser those gases that are contained in the raw materials and that are released during the reduction reaction, such as nitrogen, oxygen and hydrogen. Otherwise, atoms of these gases can enter the lattice of the crystallizing metallic titanium and reduce the quality of the titanium. Even inert gases, such as argon, are impurities in the production of metallic titanium. In addition, oxygen can form titanium oxide ($TiO_2$), which has a melting point similar to that of titanium and cannot be vaporized and evacuated from the reaction zone 4. As the gases are being evacuated from the electric-arc furnace 1 before the first iteration of the reduction reaction, the body of the electric-arc furnace 1 is simultaneously heated by the heating elements 10 to a temperature that exceeds the boiling point of the reducing agent. Because the reaction of reducing titanium tetrachloride is exothermic and occurs with heat emission, it is not necessary to heat the body of the electric-arc furnace 1 using heating elements 10 after the reduction reaction begins when the temperature in the electric-arc furnace 1 has exceeded the boiling point of the reducing agent. Thus, once this temperature is reached, the heating elements 10 are turned off. Vacuum pump 14 is also turned off. The heat generated by an electric arc 18 of the electric-arc furnace 1 is sufficient to maintain the high temperature required to sustain the reduction reaction.

As shown in FIG. 1, an electrical voltage is supplied to the consumable electrode 6 and to the dummy bar 12. In one embodiment, a positive voltage "+" is applied to the dummy bar 12, and a negative voltage "−" is applied to the consumable electrode 6. As a result of the voltage differential and the electric arc 18 that is formed, the upper part of the dummy bar 12 is melted down, and a liquid bath of molten titanium 19 is formed in the cooled crystallizer 11. Thus, the consumable electrode 6 acts as a cathode, and the liquid bath acts as an anode. The voltage across the electric-arc furnace 1 is adjusted so that the liquid bath of molten titanium 19 is maintained in the cooled crystallizer 11 during the entire process of producing titanium or a titanium alloy. Below the bath of molten titanium 19, metallic titanium crystallizes continuously throughout the entire process as reducing agent is added, consumed, evacuated as a chloride by-product, and more reducing agent and titanium tetrachloride are added. Thus, the crystallizing of the molten titanium occurs continuously twenty-four hours a day as the device of FIG. 1 is being operated.

A small amount of reducing agent (e.g., magnesium) is added in a liquid state into the reaction zone 4 of the electric-arc furnace 1. After enough time to allow the liquid reducing agent to evaporate, more reducing agent and liquid titanium tetrachloride are added to the reaction zone 4 in a stoichiometric ratio. In another embodiment, stoichiometrically similar amounts of liquid reducing agent and liquid titanium tetrachloride are added to the reaction zone 4 simultaneously before the reducing agent has evaporated. In yet another embodiment, stoichiometrically slightly more reducing agent is added than titanium tetrachloride. More titanium tetrachloride should not be added than reducing agent.

An electric arc 18 burns between the bath of molten titanium 19 or its alloy and the consumable electrode 6 of titanium, titanium alloy or another metal or metal compound. The vaporized magnesium and the vaporized titanium tetrachloride react and cause titanium from titanium tetrachloride ($TiCl_4$) to be reduced, heat to be emitted and a by-product to be generated. The by-product is the chloride of the reducing agent, in this case magnesium chloride ($MgCl_2$). The condensing portion of the reducing agent chloride falls down and approaches the electric arc 18 or the bath of molten titanium 19 and immediately boils, vaporizes and becomes gaseous. The reduced titanium partially condenses on the consumable electrode 6 (cathode). In addition, part of the condensed titanium drains to the liquid bath (anode) in the cooled crystallizer 11. Molten metal from the consumable electrode 6 also drains into the liquid bath. Metallic titanium forms on the dummy bar 12 in the cooled crystallizer 11.

When producing a titanium alloy, the alloy metal of the consumable electrode 6 melts and drains into the bath of molten titanium alloy. For example, aluminum from consumable electrode 6 melts into the bath where a titanium-aluminum alloy is crystallizing. The speed at which the aluminum electrode is lowered towards the bath controls that amount of aluminum in the titanium-aluminum alloy. Some of the aluminum from the consumable electrode 6 vaporizes and is evacuated from the reaction zone 4 by vacuum pump 14. When making some alloys, the amount of the alloy that is wasted by being vaporized and evacuated from the reaction zone 4 can be reduced by reversing the polarity of the voltage applied to the electrode and the bath. For example, more aluminum is drawn to the bath and less aluminum vaporizes if a positive charge is applied to the electrode, making it the anode.

When the pressure and temperature inside the electric-arc furnace 1 stabilize, this indicates that the titanium reduction reaction has stopped. Upon the completion of the reduction reaction, the vacuum pump 14 on the side of the condenser 13 is once again engaged. The by-products of the reduction reaction should not be evacuated, however, before the nanoparticles of titanium formed by the reduction reaction of gaseous raw materials have settled down and melted in the bath of molten titanium 19. Engaging the vacuum pump 14 too early will evacuate some of the metallic titanium and reduce the yield of the process. The boiling and gaseous reducing agent chloride is collected by pumping it out of the electric-arc furnace 1 and into the condenser 13 using the vacuum pump 14. The pumping-out of the reducing agent chloride and the evacuation of electric-arc furnace 1 are continued until the pressure in the reaction zone 4 is reduced to about $10^{-2}$ mm of mercury. Then, the reducing agent and titanium tetrachloride, both in a liquid state, are added into the reaction zone 4 of electric-arc furnace 1, and the process is repeated.

The process of producing metallic titanium or a metallic titanium alloy is a continuous process. In order to keep the process going, the following steps are iteratively performed: the consumable electrode 6 is lengthened and lowered towards the bath, the reducing agent and titanium tetrachloride are added in a liquid state to the reaction zone 4 of the electric-arc furnace 1, the reducing agent chloride is removed from the electric-arc furnace 1, and the ingot of metallic titanium or its alloy is drawn out from the bottom of the electric-arc furnace 1 and periodically cut. In one embodiment, the cylindrical titanium ingot is cut when it reaches a length of about two meters.

In order to produce metallic titanium that is free from impurities, such as hydrogen, the reaction zone 4 should be evacuated before each reduction reaction to a pressure of about $10^{-2}$ mm of mercury. Carrier gases, such as hydrogen, constitute impurities and should not be used to carry the titanium tetrachloride or the reducing agent into the reaction zone. The temperature of the titanium on the surface of the liquid bath of molten titanium 19 will be about 1700 to 1900 degrees Celsius. At 1900 degrees Celsius, for example, the vapor pressure of titanium on the surface of the liquid bath will be about 13.3 $N/m^2$ (about 100 microns of mercury). At this temperature, hydrogen trapped in the liquid bath will vaporize faster than titanium because the partial pressure of hydrogen vapor will be higher than that of titanium. Consequently, the partial pressure of hydrogen vapor will restrict the vaporization of titanium.

As the pressure in the reaction zone 4 is further decreased by the vacuum pump 14, however, degassing from the surface of the molten titanium continues. First, magnesium and magnesium chloride vaporize. Then, gases that were contained in the raw materials vaporize. And finally hydrogen vaporizes. As a result of the degassing, the concentration of hydrogen in the molten titanium decreases to the point of equilibrium at which the partial pressure of hydrogen vapor is equal to the partial pressure of titanium vapor on the surface of liquid bath of titanium. After this point of equilibrium is reached, an intensive vaporization of titanium itself begins. The vaporization of titanium is undesirable because it reduces the yield of metallic titanium. Thus, the disadvantage of reduced yield outweighs the improvements in the quality and purity of titanium when the pressure in the reaction zone 4 other than before the first reduction reaction is lowered below about $1\times10^{-3}$ mm of mercury. It has been shown empirically that at 1900 degrees Celsius the equilibrium between hydrogen and titanium vapors occurs at a pressure of about $10^{-2}$ mm of mercury. Therefore, for a reduction reaction occurring above a bath of molten titanium with a surface temperature of about 1900 degrees Celsius, the recommended pressure in the reactor zone 4 should be decreased by the vacuum pump to slightly above $10^{-2}$ mm of mercury.

Figure 2:
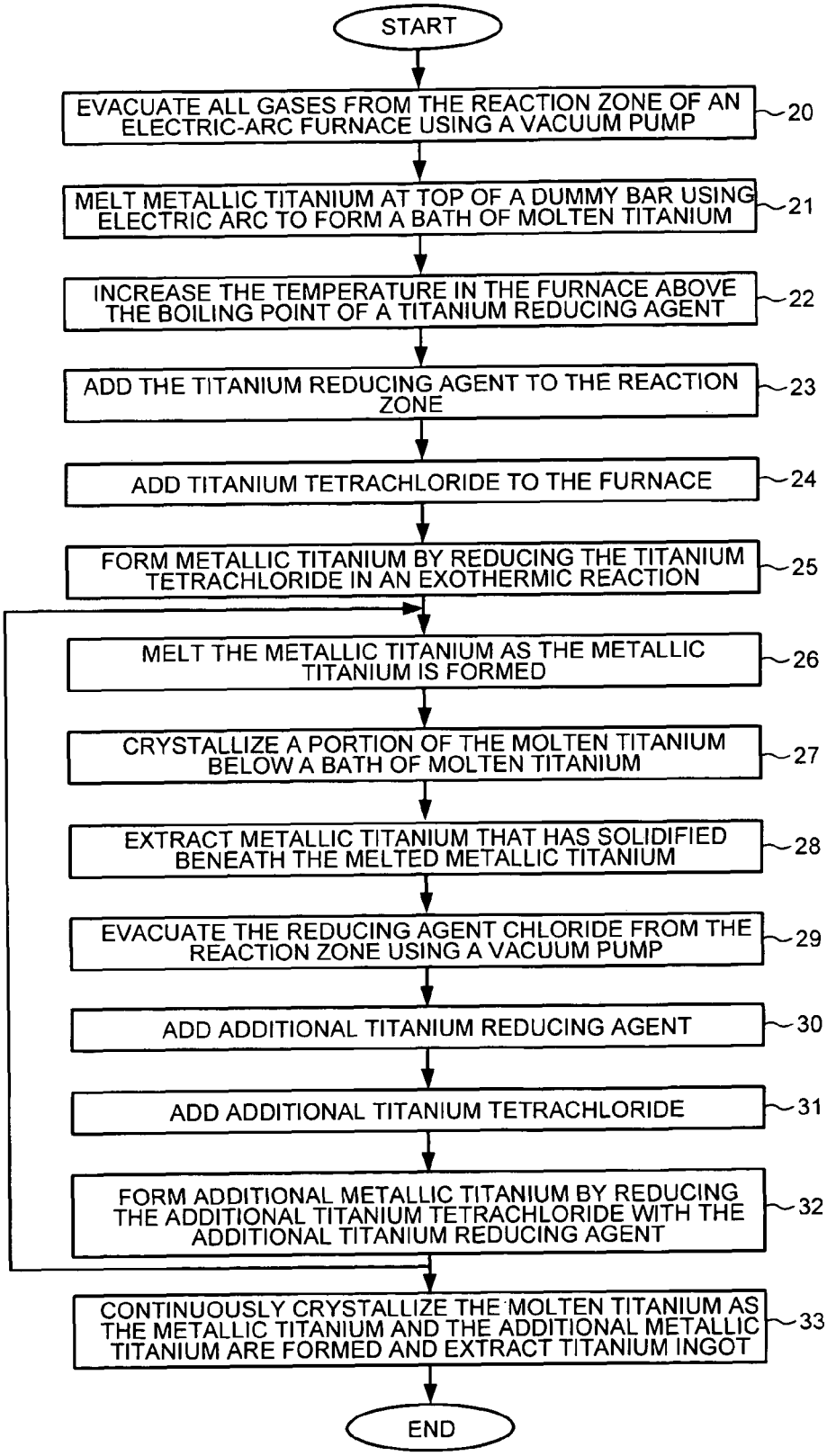
FIG. 2 is a flowchart of steps of a method for continuously crystallizing metallic titanium that is produced from the reduction of titanium tetrachloride by a reducing agent such as magnesium.

FIG. 2 is a flowchart illustrating steps 20-33 of a method for continuously crystallizing metallic titanium that is produced from the reduction of titanium tetrachloride by a reducing agent such as magnesium.

In a first step 20, all gases are evacuated from the reaction zone 4 of the electric-arc furnace 1 using the vacuum pump 14, creating a vacuum with a pressure at least as low as $5\times10^{-3}$ mm of mercury. The pressure is reduced to at least as low as $5\times10^{-3}$ mm of mercury in order to evacuate oxygen from the reaction zone 4 so that oxygen does not react with the niobium or tantalum walls 2 of the electric-arc furnace at the high temperatures of the reduction reaction. The pressure is preferably reduced even further to about $1\times10^{-3}$ mm of mercury before the first reduction reaction.

In step 21, the electric arc 18 is turned on and formed between the consumable electrode 6 and the dummy bar 12 of titanium until a liquid bath of molten titanium 19 is created.

In step 22, heating elements 10 are used to increase the temperature in the reaction zone 4 of the electric arc furnace 1 above the boiling point of the titanium reducing agent but below melting point of titanium at 1668 degrees Celsius.

In step 23, titanium reducing agent is added to the reaction zone 4 of the electric-arc furnace 1.

In step 24, titanium tetrachloride is added to the reaction zone 4.

In step 25, metallic titanium is formed by reducing the titanium tetrachloride with the titanium reducing agent in the reaction zone. As both the titanium tetrachloride and the titanium reducing agent are in a gaseous state, the metallic titanium forms as a super fine dust of atoms hanging in the atmosphere of the reaction zone 4.

In step 26, as the metallic titanium is formed from the gaseous raw materials of the reduction reaction, the dust of nanoparticles of titanium are melted by the liquid bath of molten titanium 19 and by the electric arc formed between the consumable electrode 6 and the bath of molten titanium 19.

In step 27, a portion of the melted titanium crystallizes at the bottom of the bath of molten titanium.

In step 28, metallic titanium that has solidified in the electric-arc furnace beneath the melted metallic titanium is extracted by pulling an ingot of solidified metallic titanium out of the bottom of the electric-arc furnace as more titanium is formed on top of the ingot.

In step 29, the reducing agent chloride and other impurities are evacuated from the reaction zone 4 using the vacuum pump 14 and the pressure in the reaction zone 4 is decreased to about $1\times10^{-2}$ mm of mercury. The evacuated reducing agent chloride condenses in the condenser 13. It is not necessary to reduce the pressure further to about $5\times10^{-3}$ mm of mercury in order to evacuate gases such as oxygen from the reaction zone because oxygen was initially evacuated in step 20 and does not enter the reaction zone with the raw materials. The purity of metallic titanium produced can be increased by reducing the pressure in the reaction zone 4 in step 29 below $1\times10^{-2}$ mm of mercury, but only at the expense of reduced yield of metallic titanium compared to the amount of titanium tetrachloride consumed. At one set of reaction temperatures and conditions, the yield of metallic titanium was reduced by 20% when the pressure in step 29 was reduced to $10^{-3}$ mm of mercury instead of only to $10^{-2}$ mm of mercury.

In step 30, additional titanium reducing agent is added to the reaction zone 4. Before the additional titanium reducing agent has been added to the reaction zone 4, all gases have been evacuated from the reaction zone to achieve a pressure that is sufficiently low to vaporize all of the titanium reducing agent at the particular temperature at which the reduction reaction is being carried out, which is set to be somewhere in the range between the boiling point of the titanium reducing agent and the melting point of metallic titanium. Where the reduction reaction is carried out at a lower temperature, the pressure must be reduced more in order to vaporize all of the reducing agent.

In step 31, additional titanium tetrachloride is added to the reaction zone 4. The boiling point of titanium tetrachloride is about 136 degrees Celsius, so all of the titanium tetrachloride vaporizes in the high-temperature reaction zone 4.

In step 32, additional metallic titanium is formed by reducing the additional titanium tetrachloride with the additional titanium reducing agent.

In a continuing step 33, molten titanium continuously crystallizes at the bottom of the titanium bath as the metallic titanium that has solidified is extracted from the electric-arc furnace 1. The crystallization of the molten titanium occurs continuously from the first forming of metallic titanium through the forming of additional metallic titanium as additional raw materials are added to the reaction zone 4 and by-products are evacuated.

Example

The process of producing metallic titanium was conducted in an electric-arc furnace 1 with walls 2 made of niobium. The inner diameter of the walls 2 of electric-arc furnace 1 was 36 mm, and the height was 450 mm. A dummy bar 12 of metallic titanium with a diameter of 36 mm was inserted into the cooled crystallizer 11 of the electric-arc furnace 1. A consumable titanium electrode 6 with a diameter of 10 mm was inserted into the electric holder 5. After evacuating the electric-arc furnace to $1\times10^{-3}$ mm of mercury using the vacuum pump 14 and simultaneously heating the electric-arc furnace 1 to a temperature of 1200 degrees Celsius using the heating elements 10, the electric-arc was turned on and the bath of liquid titanium was induced. The consumable electrode 6 was dropped down by 1 mm each minute. In addition, liquid magnesium in the amount of 50 grams was added to the reaction zone 4 of electric-arc furnace 1. Then, after a delay of 2 seconds, 192 grams of titanium tetrachloride was added to the reaction zone 4 of electric-arc furnace 1. The temperature in the reaction zone was increased to 1500 degrees Celsius. When the pressure and temperature in the electric-arc furnace 1 stabilized, the vacuum pump 14 was engaged and the boiling reducing agent chloride was pumped out to the condenser 13. The pumping-out of the reducing agent chloride and the evacuation of the electric-arc furnace 1 continued until the pressure in the reaction zone reached the level of $1\times10^{-3}$ mm of mercury. Then, repeatedly, 50 grams of liquid magnesium were added to the reaction zone 4. And after a delay of 2 seconds, 192 grams of titanium tetrachloride were added into the reaction zone 4 of electric-arc furnace 1. A metallic titanium ingot was formed on the dummy bar 12. The titanium ingot was drawn down with velocity of 1 mm/sec. The entire process lasted 1 hour and 30 minutes. An ingot of metallic titanium with a weight of 20 kg was obtained.

Thus, the disclosed method and device for producing metallic titanium or a metallic titanium alloy improve the quality of the obtained metallic titanium and also increase the safety level and productivity of the process for continuously producing titanium. By performing the reduction reaction of magnesium and titanium tetrachloride at a high temperature in which both raw materials are in a gaseous state instead of at the much lower temperature of the Kroll process, the speed of the reaction that produces metallic titanium is increased many times.

Although the present invention has been described in connection with certain specific embodiments for instructional purposes, the present invention is not limited thereto. Accordingly, various modifications, adaptations, and combinations of various features of the described embodiments can be practiced without departing from the scope of the invention as set forth in the claims.

What is claimed is:

1. A method comprising:

evacuating all gases from a reaction zone of an electric-arc furnace until the pressure in the reaction zone falls below $10^{-2}$ mm of mercury, wherein the reaction zone of the electric-arc furnace is enclosed by a wall made of niobium or tantalum;

adding a titanium reducing agent to the reaction zone, wherein the reaction zone has a temperature, and wherein the titanium reducing agent has a boiling point;

adding titanium tetrachloride to the reaction zone;

forming metallic titanium by reducing the titanium tetrachloride with the titanium reducing agent in the reaction zone whose temperature is above the boiling point of the titanium reducing agent;

melting the metallic titanium in the reaction zone as the metallic titanium is formed; and extracting the metallic titanium that has solidified in the electric-arc furnace beneath the molten metallic titanium.

2. The method of claim 1, wherein by an inner casing that prevents the absorption of oxygen by the wall.

3. The method of claim 1, wherein the wall includes no iron that is exposed to the reaction zone.

4. The method of claim 1, wherein the evacuating all gases is performed to a pressure below $10^{-2}$ mm of mercury that is sufficient to vaporize all of the titanium reducing agent at the temperature of the reaction zone, and wherein the temperature of the reaction zone is between the boiling point of the titanium reducing agent and the melting point of metallic titanium.

5. The method of claim 1, wherein the forming the metallic titanium generates a reducing agent chloride, further comprising:

evacuating the reducing agent chloride from the reaction zone using a vacuum pump.

6. The method of claim 5, wherein the reducing agent chloride is gaseous, further comprising:

condensing the evacuated reducing agent in a condenser.

7. The method of claim 5, further comprising:

adding additional titanium reducing agent to the reaction zone;

adding additional titanium tetrachloride to the reaction zone; and forming additional metallic titanium by reducing the additional titanium tetrachloride with the additional titanium reducing agent.

8. The method of claim 7, further comprising:

crystallizing the molten titanium before the extracting metallic titanium that has solidified, wherein the crystallizing the molten titanium occurs continuously from the forming the metallic titanium through the forming the additional metallic titanium.

9. The method of claim 1, wherein the forming the metallic titanium is performed at a temperature above the boiling point of the titanium reducing agent and below the melting point of the metallic titanium.

10. The method of claim 1, wherein the temperature of the reaction zone is increased above the boiling point of the titanium reducing agent before the adding the titanium reducing agent.

11. The method of claim 1, wherein the forming the metallic titanium forms nanoparticles of titanium.

12. The method of claim 1, wherein the molten metallic titanium solidifies on top of a dummy bar, and wherein the extracting the metallic titanium involves drawing down the dummy bar as additional metallic titanium is formed, melted and allowed to solidify.

13. A method comprising:

evacuating a reaction zone of an electric-arc furnace until the reaction zone has a pressure below $10^{-2}$ mm of mercury, wherein the reaction zone is enclosed by a wall made of niobium or tantalum;

adding a titanium reducing agent to the reaction zone, wherein the titanium reducing agent has a boiling point;

adding titanium tetrachloride to the reaction zone;

forming metallic titanium by reducing the titanium tetrachloride with the titanium reducing agent in the reaction zone whose temperature is above the boiling point of the titanium reducing agent;

melting the metallic titanium to form molten metallic titanium; and extracting metallic titanium that has solidified in the electric-arc furnace beneath the molten metallic titanium.

14. The method of claim 13, wherein the forming the metallic titanium is performed without forming sponge titanium.

15. The method of claim 13, wherein the temperature of the reaction zone is above the boiling point of the titanium reducing agent before the titanium reducing agent is added to the reaction zone.

16. The method of claim 13, wherein the titanium reducing agent is magnesium, and wherein before the forming metallic titanium only titanium tetrachloride and gaseous magnesium are present in the reaction zone.

17. A method comprising:

adding a titanium reducing agent to a reaction zone of an electric-arc furnace, wherein the titanium reducing agent has a boiling point, and wherein the reaction zone of the electric-arc furnace is enclosed by a wall made of niobium or tantalum;

evacuating all gases from the reaction zone until the reaction zone has a pressure that is sufficiently low to vaporize all of the titanium reducing agent;

adding titanium tetrachloride to the reaction zone;

forming metallic titanium by reducing the titanium tetrachloride in the reaction zone whose temperature is above the boiling point of the titanium reducing agent;

melting the metallic titanium to form molten metallic titanium; and extracting metallic titanium that has solidified in the electric-arc furnace beneath the molten metallic titanium.

18. The method of claim 17, wherein the molten titanium is formed at the bottom of the electric-arc furnace by melting nanoparticles of the metallic titanium formed by reducing the titanium tetrachloride.

19. The method of claim 17, wherein the evacuating all gases is performed before the adding the titanium reducing agent.

20. The method of claim 17, wherein the temperature of the reaction zone is above the boiling point of the titanium reducing agent before the titanium reducing agent is added to the reaction zone.

* * * * *